United States Patent [19]

Heisler et al.

[11] 4,308,969

[45] Jan. 5, 1982

[54] TAMPER INDICATING CLOSURE STRUCTURE

[75] Inventors: Jerome S. Heisler; Anthony J. Starr, both of Wilmington, Del.

[73] Assignee: Container Corporation of America, Chicago, Ill.

[21] Appl. No.: 92,204

[22] Filed: Nov. 7, 1979

[51] Int. Cl.[3] ..... B65D 47/10

[52] U.S. Cl. ..... 220/266; 220/288; 215/253; 222/541

[58] Field of Search ..... 222/153, 552, 551, 541; 220/266, 288; 215/252, 253

[56] References Cited

U.S. PATENT DOCUMENTS 4,062,466 12/1977 Conti ..... 215/252
4,126,240 11/1978 Brach ..... 215/252
4,153,174 5/1979 Keeler ..... 215/252

FOREIGN PATENT DOCUMENTS 6514511 5/1967 Netherlands ..... 215/222

*Primary Examiner*—Howard N. Goldberg
*Assistant Examiner*—Fred A. Silverberg
*Attorney, Agent, or Firm*—Richard W. Carpenter; Davis Chin

[57] ABSTRACT

A tamper indicating closure for a threaded pouring spout having an external ratchet surface disposed near the base of the pouring spout is provided with a pawl-like member cooperating with the ratchet surface and maintaining integrity during closing but rupturing upon opening to give a visual indication that the container has been opened.

3 Claims, 7 Drawing Figures

TAMPER INDICATING CLOSURE STRUCTURE

SUMMARY OF THE INVENTION

The present invention finds special application for use with containers formed from resinous material in either blow molding or gyratory molding operations. The molded container is formed integrally with a pouring spout which, in the present case, is internally threaded for a plug type closure. The base of the pouring spout is provided with a ratchet surface cooperating with a pawl-like member formed integrally with the closure, the member giving a visual indication that the container has been opened upon tampering with the closure.

THE DRAWINGS

Figure 1:
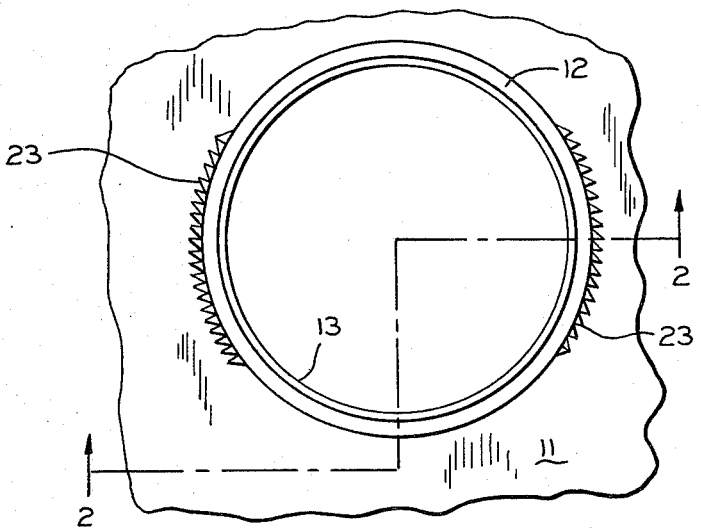
FIG. 1 is a plan view of a portion of a container at the pouring spout thereof, showing a ratchet surface at such pouring spout.
Figure 2:
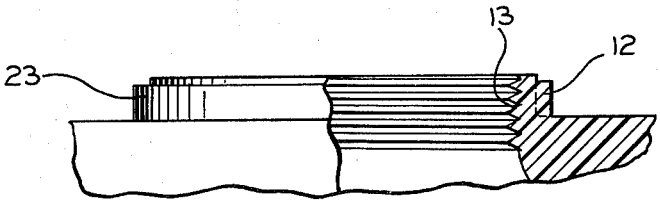
FIG. 2 is a sectional view taken generally along the line 2—2 of FIG. 1.
Figure 3:
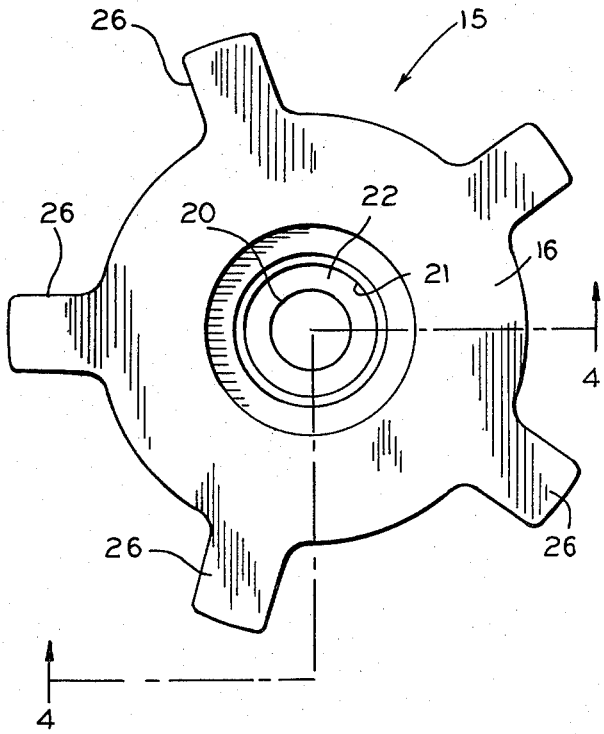
FIG. 3 is a plan view of a closure arranged to be secured at the pouring spout shown in FIG. 1.
Figure 4:
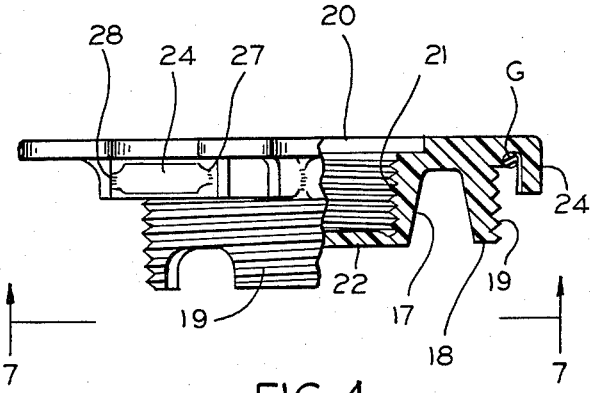
FIG. 4 is a combined elevational and sectional view taken along the line 4—4 of FIG. 3.
Figure 5:
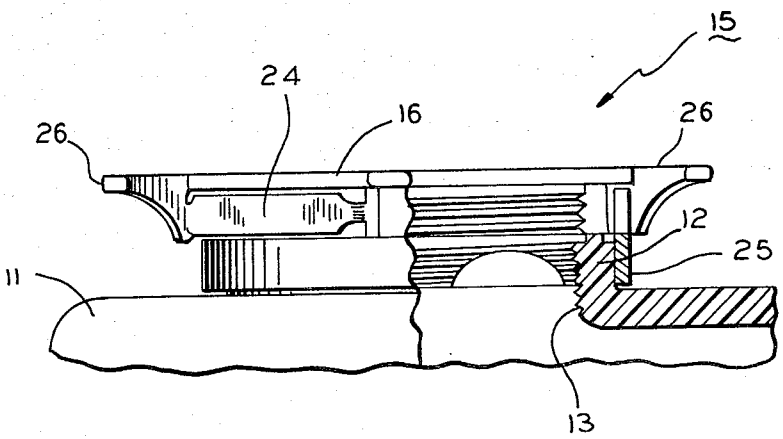
FIG. 5 is an elevational and partially sectional view showing the closure of FIG. 3 in position atop the pouring spout of FIG. 1 preparatory to a closing operation.

A tamper indicating structure according to the present invention is shown in the environment of a container body 11 having a cylindrical pouring spout 12, generally in the top wall thereof. The pouring spout 12 is provided with internal threads 13, and a container closure 15 is secured to pouring spout 12 by a threaded engagement.

The closure 15 has a top wall 16 with inner and outer annular flanges 17 and 18 depending therefrom in coaxial spaced relationship.

A gasket G is received around the outer flange 18 and under the wall 16, the gasket being brought into sealing contact with the pouring spout 12 by an engagement of threads 19 on the flange 18 with the threads 13 of the pouring spout 12.

The wall 16 may have a recess 20 which is threaded internally as at 21. A bottom of the recess 20 is closed by a diaphragm 22 which can be ruptured if desired, so that a spigot (not shown) can be received in the recess 20 for draining of the container 11.

Structure is provided for giving a visual indication that the closure 15 has been tampered with. The base of the pouring spout 12 is provided with ratchet-like surfaces 23 which cooperate with pawl-like members 24 extending between lugs 26. Each member 24 is connected between adjacent lugs by a rupturable web 27 at one end thereof and by a non-rupturable web 28 at the other end thereof.

The container 11 and the closure 15 are ordinarily shipped as a unit prior to filling. The threaded engagement of the closure 15 with the container 11 is limited by an expendable collar 25 disposed around the spout 12 and covering the ratchet-like surfaces 23 at the base of the spout 12.

After the filling operation of the container 11, the closure 15 is threaded into the spout 12 in the conventional clock-wise fashion, the pawl-like members 24 of the closure 15 riding readily over the teeth of the ratchets 23 until sealing of the spout 12 is achieved.

Figure 7:
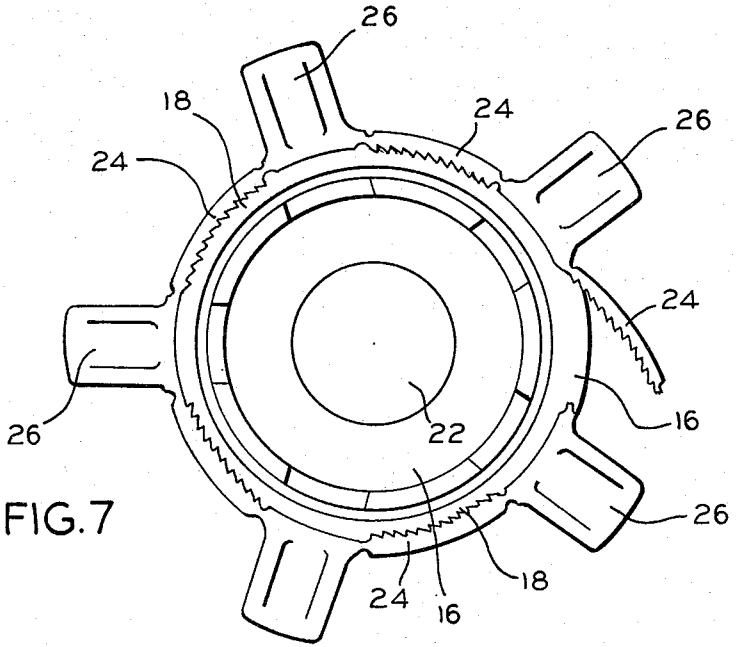
FIG. 7 is a sectional view taken generally along the line 7—7 of FIG. 5 illustrating a condition of the closure after opening.
Figure 6:
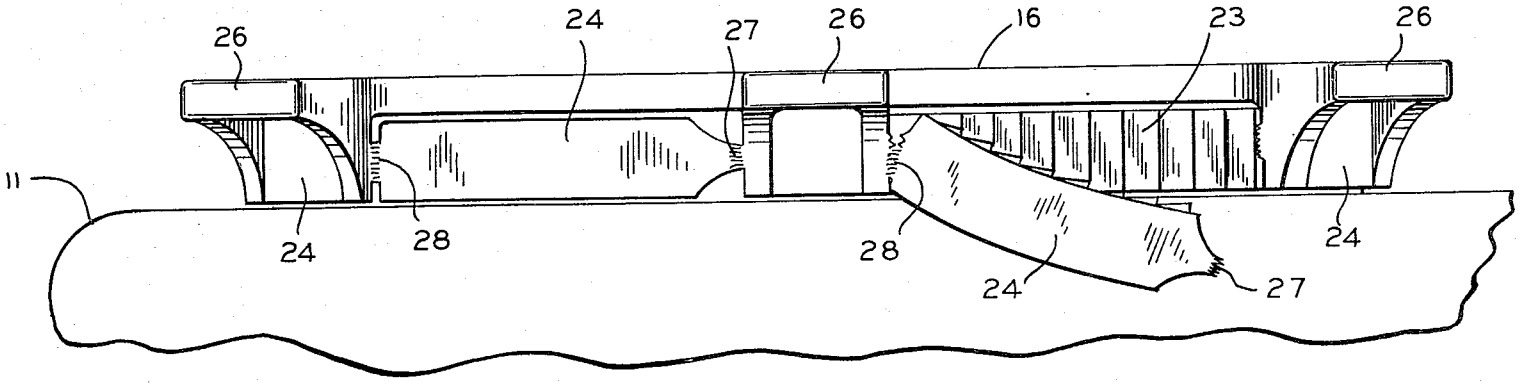
FIG. 6 is an elevational view showing the closure in position and having been previously subjected to an opening operation indicated by the condition of the closure.

When the closure 15 is rotated in a counter-clockwise direction, the pawl members 24 engage with the ratchet members 23 and cause the webs 27 to rupture. Continued counter-clockwise movement causes the members 24 to "wing out," as seen in FIGS. 6 and 7, thus affording a readily visible indication that the closure 15 has been tampered with.

We claim:

1. In a tamper indicating closure structure for a container body having an internally threaded pouring spout provided with a ratchet surface disposed externally of and near the base of said pouring spout:

(a) an externally threaded closure for said pouring spout arranged for engagement with the threads of said pouring spout, said closure having a plurality of lugs disposed in an equally spaced manner around its outer surface;

(b) a plurality of pawl-like members supported by said closure between said lugs and arranged to override said ratchet surface during closing movement of said closure and to engage said ratchet surface during opening movement of said closure;

(c) each of said pawl-like members being connected to said closure by a pair of webs spaced longitudinally of each said pawl-like member and connected to said closure;

(d) both of said webs being capable of maintaining integrity during closing movement of said closure;

(e) one of said webs being ruptured upon opening movement of said closure;

(f) the other of said webs having its integrity with said closure maintained after such opening movement to give a visual indication that said closure has been subjected to an opening movement; and (g) said closure includes a top wall with inner and outer annular flanges depending therefrom in a coaxial spaced relationship, said outer annular flange being threaded on its outer surface to connect with the internally threaded pouring spout when the closure is attached thereto and wherein a gasket is disposed around said outer flange and under said top wall so as to provide a sealing contact with the pouring spout during the closing movement.

2. In a tamper indicating closure structure as claimed in claim 1, wherein said top wall has a recess which is threaded internally and is adapted to receive a spigot for draining of the container.

3. In a tamper indicating closure structure as claimed in claim 1, further comprising an expendable collar disposed around said spout to limit initial threaded engagement of said closure to the container.

* * * * *